US008220920B2

(12) United States Patent
Saito et al.

(10) Patent No.: US 8,220,920 B2
(45) Date of Patent: Jul. 17, 2012

(54) TRANSPORT ROLLER, TRANSPORT DEVICE AND PRINTING APPARATUS

(75) Inventors: Koichi Saito, Matsumoto (JP); Kenji Ozawa, Shiojiri (JP); Ryoji Uesugi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 12/813,673

(22) Filed: Jun. 11, 2010

(65) Prior Publication Data

US 2010/0315474 A1 Dec. 16, 2010

(30) Foreign Application Priority Data

Jun. 12, 2009 (JP) ..... 2009-141181

(51) Int. Cl.
*B41J 2/01* (2006.01)
*B25F 5/02* (2006.01)
*F16C 13/00* (2006.01)

(52) U.S. Cl. ..... 347/104; 492/15

(58) Field of Classification Search ..... 347/104; 492/15

See application file for complete search history.

(56) References Cited

U.S. PATENT DOCUMENTS 6,540,218 B2 4/2003 Tsukada et al.
7,610,938 B2 11/2009 Yanokura et al.

FOREIGN PATENT DOCUMENTS

JP 10-109777 4/1998
JP P3271048 1/2002
JP 2006-289496 10/2006

*Primary Examiner* — Stephen Meier
*Assistant Examiner* — Alexander C Witkowski
(74) *Attorney, Agent, or Firm* — Workman Nydegger

(57) ABSTRACT

A transport device includes a transport roller that is formed into a cylindrical shape in such a manner that a pair of end surfaces thereof are matched with each other by press working, and includes a medium supporting region in a part thereof in a longitudinal direction, while the medium supporting region supporting a medium; and a bearing that pivotally supports a region of the transport roller, the region being other than the medium supporting region. The transport roller includes an opening in the region other than the medium supporting region in a seam formed by matching the pair of end surfaces with each other.

13 Claims, 12 Drawing Sheets

TRANSPORT ROLLER, TRANSPORT DEVICE AND PRINTING APPARATUS

BACKGROUND

1. Technical Field

The present invention relates to a transport roller, a transport device and a printing apparatus.

2. Related Art

Heretofore, a variety of printers have been provided as printing apparatuses. In each of such printers, a recording medium (transported medium) such as a printing sheet is transported by a variety of rollers. To be more specific, the recording medium is transported to a printing unit by a transport roller and a driven roller, to perform printing for the recording medium in the printing unit, and to thereafter discharge the recording medium by a discharge roller and a driven roller.

In particular, the transport roller pinches the printing sheet between the driven roller and the transport roller, and is rotationally driven in this state, thereby moving the sheet in a sub-scanning direction perpendicular to a moving direction of a carriage. Hence, the transport roller is required to have high transport capability since the transport roller transports the printing sheet to a recording position with high accuracy, and further, sequentially sends a plurality of printing sheets in accordance with a printing speed.

In order to make the transport roller maintain large frictional force, Japanese Patent No. 3,271,048 discloses a technology for forming a large number of protrusions on a circumferential surface of a metal round bar by a perforation process.

However, in this technology, the protrusions are formed on the surface of such a shaft-like (columnar) bar along a circumferential direction thereof, and accordingly, a problem of poor workability is inherent therein. Moreover, since such a solid material is used, there is also a problem that, for example, total weight and cost of a printer using the transport roller are increased.

Based on such a background, in order to reduce cost in the solid shaft, JP-A-2006-289496 proposes that a metal plate is bent into a form of a cylinder-like (hollow) shaft (that is, a cylindrical shaft), and this cylindrical shaft is used in place of the metal solid round bar material.

In the case of bending a metal plate into a form of a cylindrical shaft, end surfaces of the metal plate are matched with each other, and accordingly, on the surface of the cylindrical shaft, a slight gap or a groove (seam) is formed across the overall length thereof.

Therefore, if the cylindrical shaft described in JP-A-2006-289496 is used, for example, as a transport roller of the printer, then a phenomenon occurs that lubricant (such as grease) supplied between the transport roller and a bearing that supports the transport roller flows through the seam by a capillary action.

Then, there occurs a problem that the lubricant permeates a region where the transport roller contacts with the recording medium (transported medium), and soils the recording medium with the lubricant.

SUMMARY

An advantage of some aspects of the invention is to provide a transport roller capable of reducing weight and cost thereof and of preventing the transported medium from being soiled, and to provide a transport device and a printing apparatus, each using the transport roller.

The transport roller, the transport device and the printing apparatus, which are according to the aspects of the invention, are configured as below in order to solve the foregoing problems.

The transport device according to an aspect of the invention includes a transport roller that is formed into a cylindrical shape in such a manner that a pair of end surfaces thereof are matched with each other by press working, and has a medium supporting region in a part thereof in a longitudinal direction, the medium supporting region supporting a medium; and a bearing that pivotally supports a region of the transport roller, the region being other than the medium supporting region. The transport roller includes an opening in the region other than the medium supporting region in a seam formed by matching the pair of end surfaces with each other.

In accordance with the aspect, even in the case where a cylindrical shaft formed into the cylindrical shape by press working is used as the transport roller, the medium brought into contact with the medium supporting region can be prevented from being soiled with the lubricant supplied to the bearing. In other words, even if the lubricant supplied to the bearing for the transport roller flows through the seam of the transport roller, the lubricant can be prevented from being permeated the medium supporting region since the opening functions as a flow stopper.

Moreover, the medium supporting region can also be prevented from being soiled with the lubricant, and accordingly, favorable transport capability can be maintained.

In the transport device, the opening is arranged between the medium supporting region and the region supported by the bearing.

Accordingly, the lubricant supplied to the bearing can be surely prevented from reaching (permeating) the medium supporting region through the seam.

In the transport device, at least one opening is arranged on each of both sides of the medium supporting region.

Accordingly, the medium supporting region can be completely prevented from being soiled with the lubricant flowing through the seam.

In the transport device, a distance between the pair of end surfaces in the opening is set in response to surface tension of the lubricant supplied to the bearing.

Accordingly, it becomes possible to stop, in the opening, the lubricant flowing through the seam by the capillary action. To be more specific, since intensity of the capillary action of the lubricant is proportional to surface tension of the lubricant, and is inversely proportional to a size of a capillary (that is, distance between the end surfaces of the seam), the distance between the end surfaces in the opening just needs to be set so that the capillary action cannot occur in response to the surface tension of the lubricant.

Further, the medium supporting region is provided on a center portion of the transport roller, the center portion excluding both end portions thereof.

As usual, both end portions of the transport roller become regions for attaching thereto coupling components of a drive system, such as gears, and it is a center portion of the transport roller that directly contacts with the medium such as a recording sheet. Hence, the center portion that directly contacts with the medium is prevented from being soiled with the lubricant, whereby the medium can be surely prevented from being soiled.

In the transport device, the medium supporting region is made of a high friction layer containing inorganic particles.

In the transport roller that transports the recording sheet as the medium, the high friction layer becomes such a region that directly contacts with the medium. Accordingly, the region is prevented from being soiled with the lubricant, whereby the medium can be surely prevented from being soiled. Moreover, frictional force by the high friction layer can be maintained, and accordingly, favorable transport capability can be maintained.

The printing apparatus according an aspect of the invention includes a transport unit that transports a recording medium by a transport roller, and a printing unit that performs printing processing for the recording medium transported by the transport unit, and the transport unit according to the aspect of the invention is used as the transport device.

In accordance with the aspect, at the time when the transport roller of the transport unit contacts with the recording medium, the recording medium (transported medium) is not soiled with the lubricant supplied to the bearing for the transport roller, and accordingly, favorable printing processing can be maintained.

The transport roller according to an aspect of the invention is formed into a cylindrical shape in such a manner that a pair of end surfaces thereof are matched with each other by press working, includes a medium supporting region in a part thereof in a longitudinal direction while the medium supporting region supporting a medium, and includes an opening in a region other than the medium supporting region in a seam formed by matching the pair of end surfaces with each other.

In accordance with this aspect, even in the case where the cylindrical shaft formed into the cylindrical shape by the press working is used as the transport roller, the medium brought into contact with the medium supporting region can be prevented from being soiled with a liquid, or the like attached to the transport roller. In other words, even if the liquid, or the like attached to the transport roller flow through the seam of the transport roller, the liquid, or the like can be prevented from being permeated the medium supporting region since the opening functions as a flow stopper.

Moreover, the medium supporting region can also be prevented from being soiled with the liquid, and accordingly, the favorable transport capability can be maintained.

BRIEF DESCRIPTION OF THE DRAWINGS

The invention will be described with reference to the accompanying drawings, wherein like numbers reference like elements.

DESCRIPTION OF EXEMPLARY EMBODIMENTS

A description will be made below of an embodiment of the invention with reference to the drawings.

Note that, in the respective drawings for use in the following description, scales of the respective members are changed as appropriate in order to recognizably display the respective members.

Figure 1:
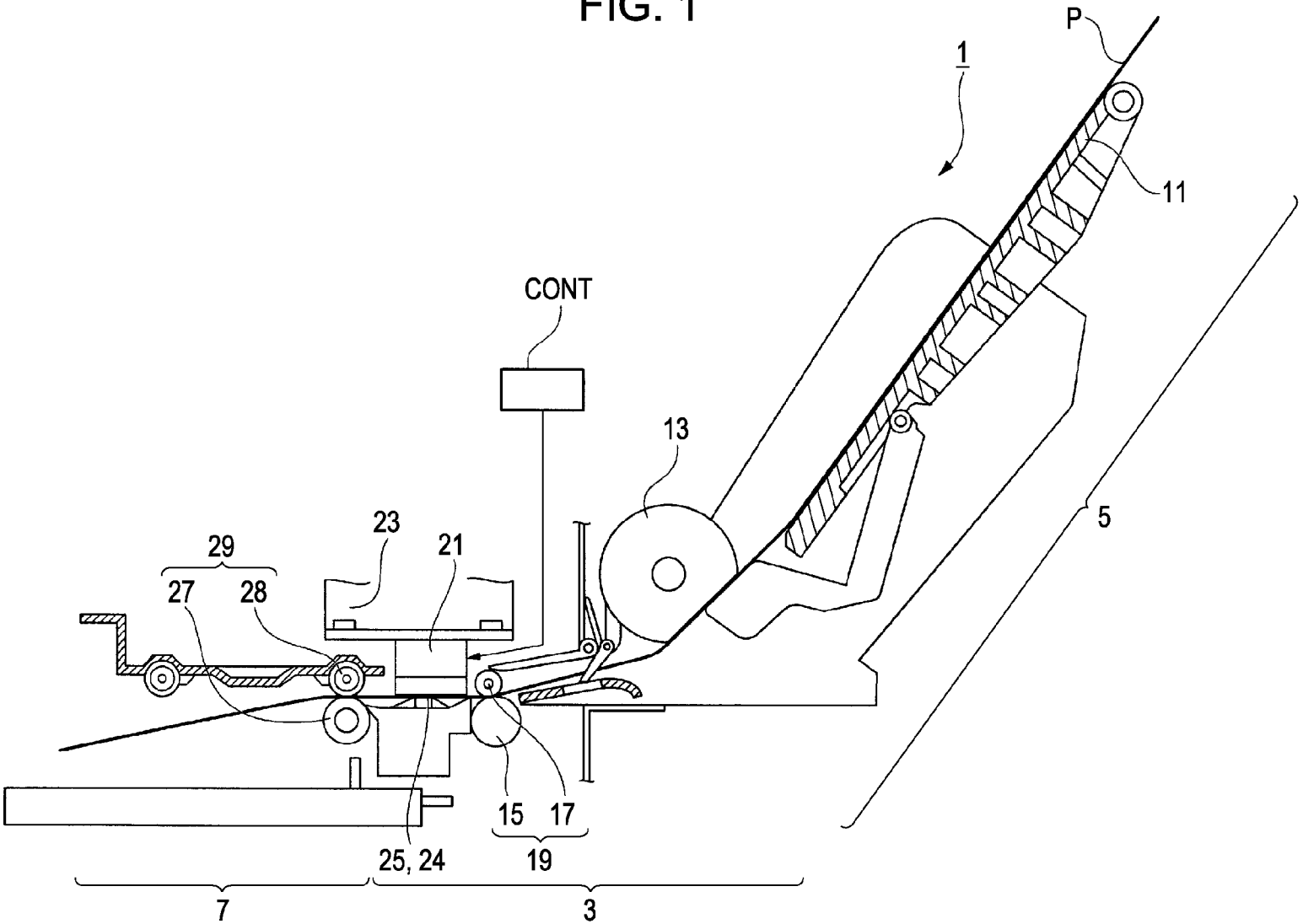
FIG. 1 is a side cross-sectional view of an ink jet printer according to the invention.

FIG. 1 is a side cross-sectional view of an ink jet printer according to the embodiment of the invention.

Figure 2B:
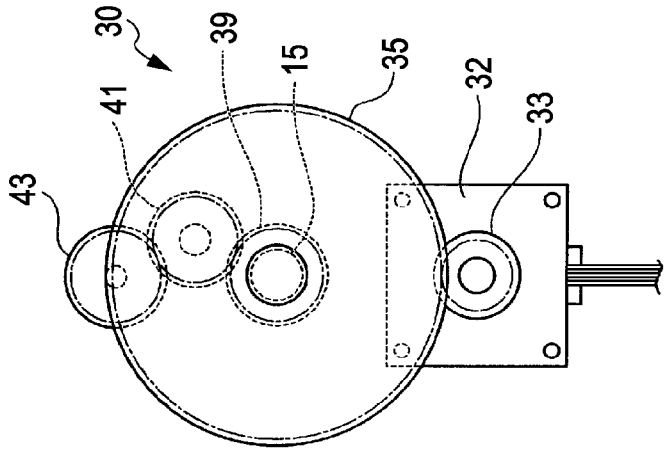
FIG. 2B is a side view of a drive system.
Figure 2A:
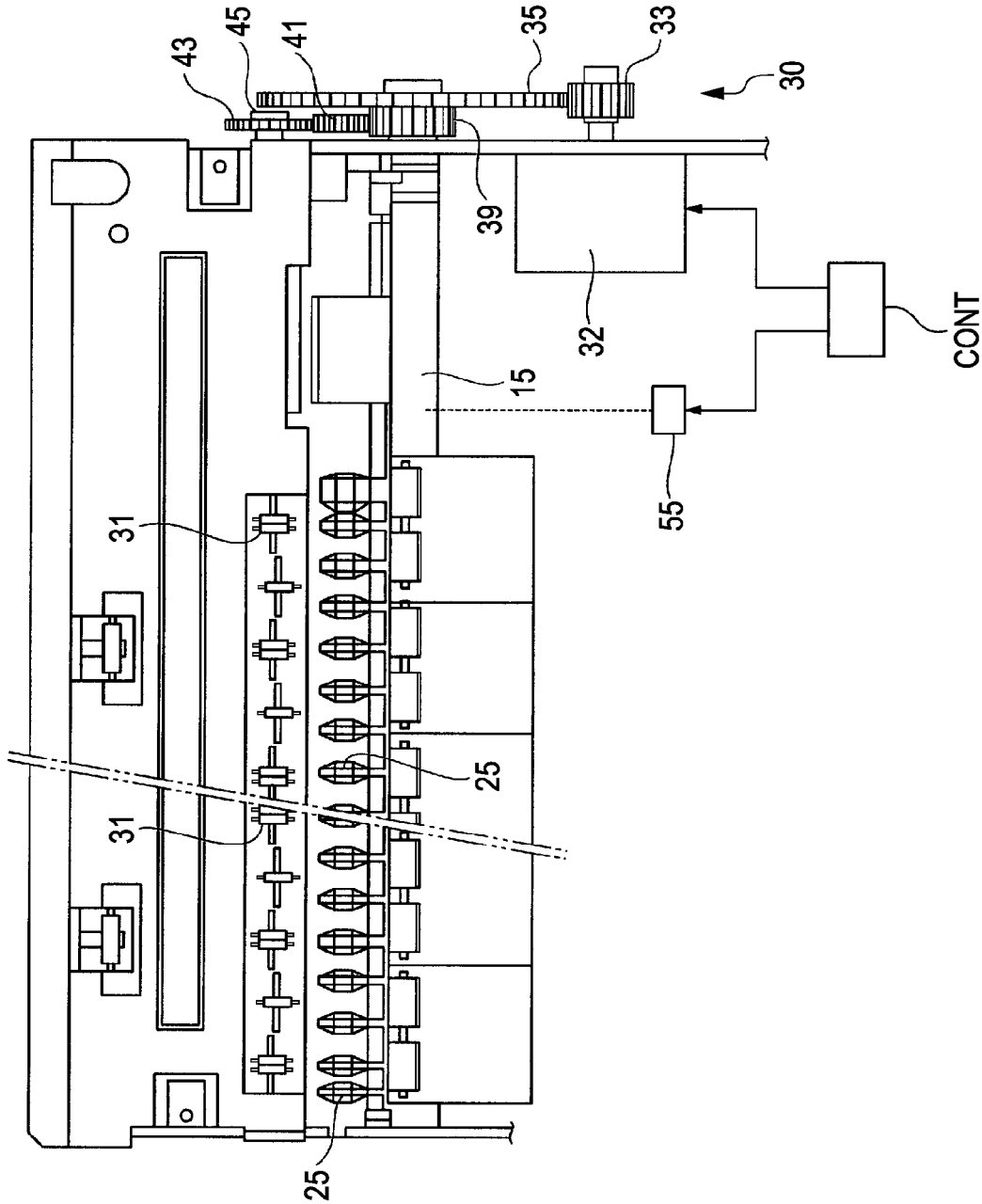
FIG. 2A is a plan view of a transport unit.

FIG. 2A is a plan view illustrating a transport unit of the ink jet printer, and FIG. 2B is a side view of a drive system of the transport unit.

As illustrated in FIG. 1, the ink jet printer 1 includes: a printer main body 3; a sheet feed unit 5 provided on an upper rear portion of the printer main body 3; and a discharge unit 7 formed in front of the printer main body 3.

In the sheet feed unit 5, a sheet feed tray 11 is provided, and plural sheets (mediums including recording mediums (transported mediums)) P are stacked on the sheet feed tray 11. As the sheets P, there are used plain paper, coated paper, sheets for an OHP (overhead projector), glossy paper, glossy films and the like.

A sheet feed roller 13 is provided on a downstream side of the sheet feed tray 11. The sheet feed roller 13 is configured so as to pinch the uppermost sheet among the plural sheets P, which are stacked on the sheet feed tray 11, between the sheet feed roller 13 itself and a separation pad (not shown) opposite thereto, and to send the pinched sheet P forward.

The sent sheet P reaches a transport roller mechanism 19, the mechanism includes a transport roller 15 arranged on a lower side, and a driven roller 17 arranged on an upper side.

Then, while being subjected to a precise and accurate transport (sheet feed) operation, which follows printing processing, by rotational drive of the transport roller 15, the sheet P that has reached the transport roller mechanism 19 is transported to a printing head (printing unit) 21 located on the downstream side of the transport roller mechanism 19.

The printing head 21 is held on a carriage 23, and the carriage 23 reciprocatively moves in a direction perpendicular to a sheet feed direction (transport direction of the sheet P).

At a position opposite to the printing head 21, a platen 24 is arranged. The platen 24 includes a plurality of diamond ribs 25 arranged at an interval along a moving direction of the carriage 23. The diamond ribs 25 support the sheet P from a lower side thereof at the time of performing printing on the sheet P by the printing head 21. To be more specific, top surfaces of the diamond ribs 25 function as support surfaces for the sheet P.

The process of printing characters (printing process) by the printing head 21 is controlled by a control unit CONT.

A distance between the printing head 21 and the diamond ribs 25 is made adjustable in response to a thickness of the sheet P, and the sheet P is thereby being printed with high quality while smoothly passing on the top surfaces of the diamond ribs 25. The plurality of sheets P subjected to the printing by the printing head 21 are sequentially delivered by a discharge roller 27 provided in the discharge unit 7.

A discharge roller mechanism 29 includes the discharge roller 27 arranged on the lower side, and a discharge Giza roller 28 arranged on the upper side. The discharge roller mechanism 29 pulls out and delivers the sheet P by rotational drive of the discharge roller 27.

A description will be made of a relationship between a drive unit 30 of the transport roller mechanism 19 and the discharge roller mechanism 29 and a drive speed of the transport roller 15 and the discharge roller 27.

As shown in FIGS. 2A and 2B, in the printer main body 3, a transport motor 32 driven under control of the control unit CONT is provided. A pinion 33 is provided around a drive shaft of the transport motor 32. A transport drive gear 35 meshes with the pinion 33. The transport roller 15 is inserted into and coupled to the transport drive gear 35.

With such a configuration, the transport motor 32 and the like configure the drive unit 30 that rotationally drives the transport roller 15.

Around the transport roller 15, an inner gear 39 is provided coaxially with the transport drive gear 35. An intermediate gear 41 meshes with the inner gear 39. A discharge drive gear 43 meshes with the intermediate gear 41. As shown in FIG. 2A, a rotation shaft of the discharge drive gear 43 becomes a shaft body 45 of the discharge roller 27.

With such a configuration, the transport roller 15 of the transport roller mechanism 19 and the discharge roller 27 of the discharge roller mechanism 29 are driven by receiving rotational drive force from the transport motor 32 as the same drive source.

By adjusting a gear ratio among the respective gears, a rotation speed of the discharge roller 27 is set faster than a rotation speed of the transport roller 15. Hence, a discharge speed of the discharge roller mechanism 29 is faster than a transport speed of the transport roller mechanism 19 by an amount corresponding to a speed increasing ratio.

Pinching force (pressing force) for the sheet P by the transport roller mechanism 19 is set larger than pinching force (pressing force) by the discharge roller mechanism 29. Hence, when both of the transport roller mechanism 19 and the discharge roller mechanism 29 pinch the sheet P, a discharge speed for the sheet P is defined by the transport speed of the transport roller mechanism 19 regardless of the discharge speed of the discharge roller mechanism 29.

Next, a description will be made of the transport roller 15 according to the invention and the transport roller mechanism 19 including the transport roller 15.

Figure 3A:
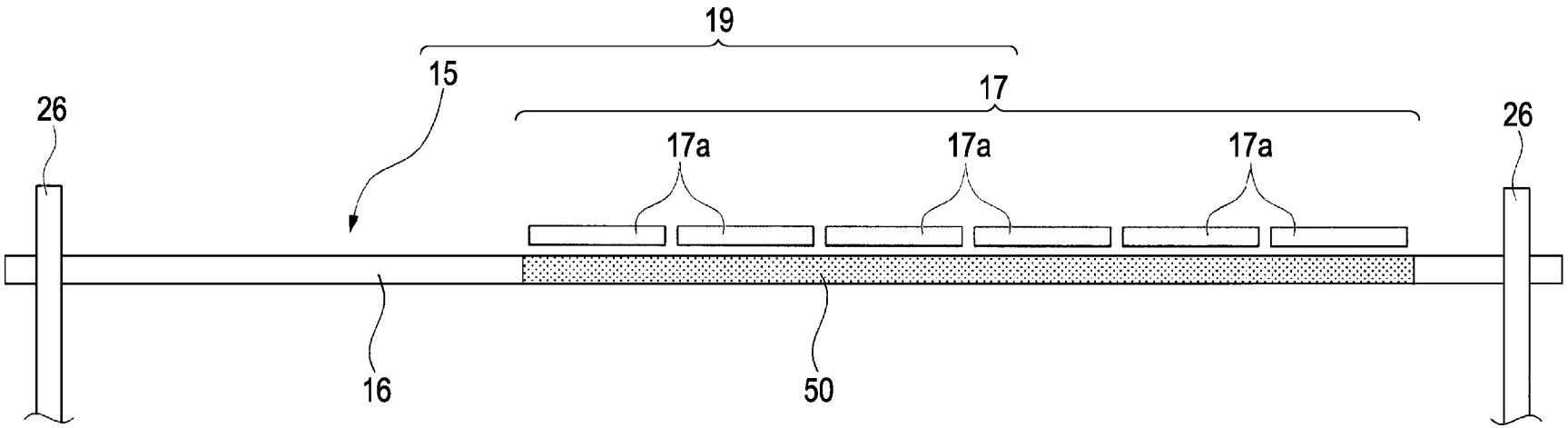
FIG. 3A is a schematic configuration view of a transport roller mechanism.
Figure 3B:
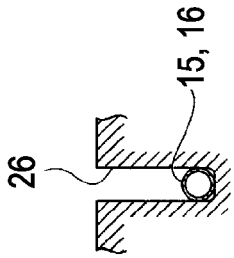
FIG. 3B is a view illustrating a schematic configuration of a bearing.

FIG. 3A is a view illustrating a schematic configuration of the transport roller mechanism 19, and FIG. 3B is a view illustrating a schematic configuration of a bearing.

The transport roller 15 includes a roller main body 16 in which a metal plate such as a zinc-plated steel plate or a stainless steel plate is pressed to be formed into a cylindrical shape, and a high friction layer 50 provided on a surface of the roller main body 16.

Both end portions of the transport roller 15 are rotatably held by bearings 26 formed integrally with the platen 24. As shown in FIG. 3B, each of the bearings 26 is formed into a U-shape opened upward, and fits the transport roller 15 into such a U-shape spot of itself, thereby pivotally supporting the transport roller 15 in three directions, that is, from front, rear and lower sides. Moreover, lubricant (lubrication liquid) such as grease L is supplied (applied) to a contact surface (surface of the transport roller 15) between the bearing 26 and the transport roller 15.

The transport roller 15 having the high friction layer 50 and the bearings 26 which support the transport roller 15 configure the transport unit (transport device) 20.

On one or both ends of the transport roller 15, engagement portions (not shown) which the inner gear 39, the transport drive gear 35 and the like are unrotatably to engage with and to be coupled to are formed. On the transparent roller 15, it is possible to form engagement portions with a variety of forms in order to couple a variety of coupling components thereto.

In this embodiment, the high friction layer 50 is selectively formed on a center portion of the roller main body 16, while both end portions thereof are excluded.

The driven roller 17 is configured in such a manner that a plurality (for example, six) of rollers 17*a* are arrayed coaxially with one another. The rollers 17*a* are arranged at positions which are opposite to the high friction layer 50 of the transport roller 15 and abut on the high friction layer 50 concerned. An urging spring (not shown) is attached to the driven roller 17 including the rollers 17*a*, whereby the driven roller 17 is urged to the transport roller 15 side.

Hence, the driven roller 17 abuts on the high friction layer 50 of the transport roller 15 with predetermined pressing force (pinching force for the sheet P), and rotates following a rotation operation of the transport roller 15. The pinching force for the sheet P is increased between the transport roller 15 and the driven roller 17, and transportability for the sheet P is improved.

In order to absorb damage to surfaces of the respective rollers 17*a* of the driven roller 17, which is caused due to slide contact thereof with the high friction layer 50, for example, the surfaces of the rollers 17*a* are subjected to abrasion reduction treatment, for example, such as fluorine resin coating.

The roller main body 16 is formed into the cylindrical shape in such a manner that the metal plate is pressed and a pair of end surfaces thereof opposite to each other are allowed to approach each other. Hence, in the roller main body 16, the pair of end surfaces are slightly spaced apart from each other. Accordingly, a seam is formed between the end surfaces.

Figure 4A:
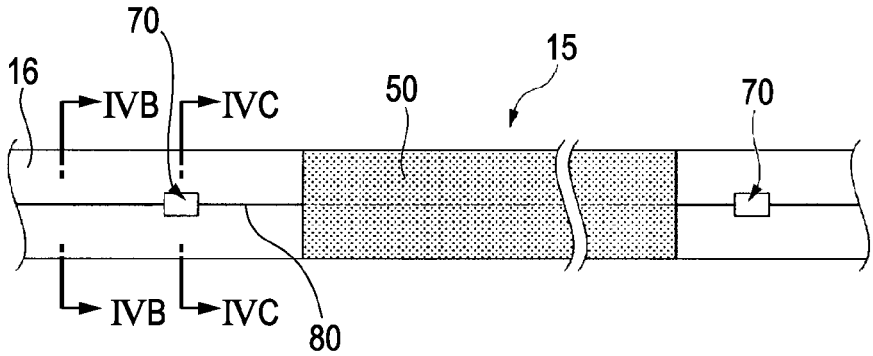
FIG. 4A is a plan view illustrating a transport roller.
Figure 4B:
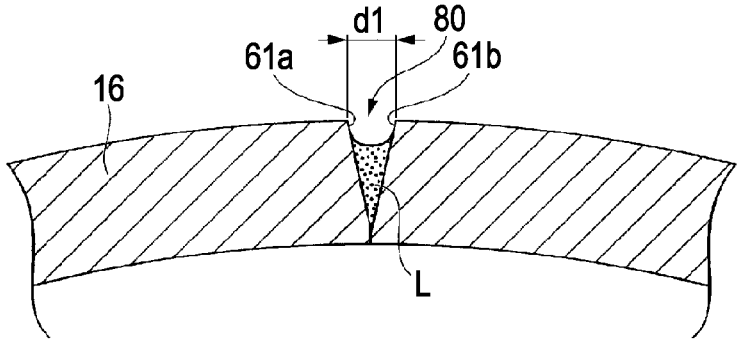
FIG. 4B is a cross-sectional view illustrating a seam thereof.
Figure 4C:
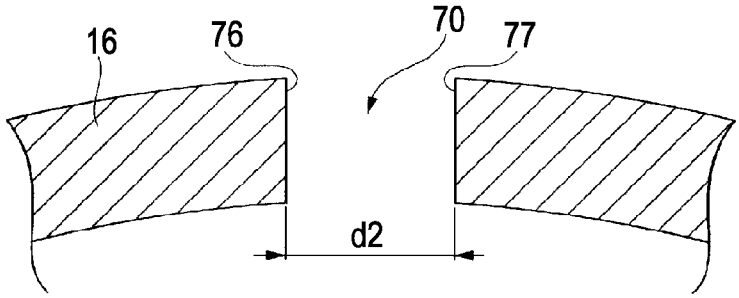
FIG. 4C is a cross-sectional view illustrating an opening thereof.

FIG. 4A is a plan view illustrating the transport roller. FIG. 4B is a cross-sectional view illustrating the seam. FIG. 4C is a cross-sectional view illustrating an opening of the transport roller.

The transport roller 15 (roller main body 16) is formed into the cylindrical shape in such a manner that a metal plate 65 is pressed and a pair of end surfaces 61*a* and 61*b* thereof are matched with each other. Accordingly, a seam 80 is formed over the overall length of the transport roller 15 in the longitudinal (axial) direction by matching the end surfaces 61*a* and 61*b* with each other.

As shown in FIG. 4B, the seam 80 has a groove shape, in which inner circumferential sides of the pair of end surfaces 61*a* and 61*b* directly contact with each other, and outer circumferential sides thereof are spaced apart from each other. Alternatively, in some case, the seam 80 is formed as a gap in such a manner that the pair of end surfaces 61*a* and 61*b* are slightly spaced from each other without abutting on each other.

In the case of forming the transport roller 15 (roller main body 16) by such press working, it is extremely difficult to perfectly bring the pair of end surfaces 61*a* and 61*b* into direct contact with each other without forming the gap therebetween. Accordingly, on the surface of the transport roller 15 (roller main body 16), the groove or the gap is formed as the seam 80. A size of the seam 80, that is, a maximum distance d1 between the end surfaces 61*a* and 61*b* is set, for example, at 200 μm or less.

As described above, on the surface of the transport roller 15 (roller main body 16), the groove or the gap is formed as the seam 80. The seam 80 is formed across the overall length of the transport roller 15. Accordingly, when the grease L supplied to the bearings 26 attaches to the surface of the transport roller 15, the grease L flows through the seam 80 due to a capillary action. In particular, as the seam 80 (maximum distance d1 between the end surfaces 61*a* and 61*b*) is made smaller in order to enhance strength of the transport roller 15, the capillary action of the grease L becomes stronger, and the grease L becomes likely to flow along the seam 80.

An opening 70 is provided in a part of the seam 80 formed in the transport roller 15 (roller main body 16). As shown in FIG. 4C, the opening 70 is formed of notched portions 76 and 77 provided in the pair of end surfaces 61*a* and 61*b* respectively, which form the seam 80. A maximum distance d2 between the notched portions 76 and 77 is set so as to become approximately 1 mm or more when the end surfaces 61*a* and 61*b* are matched with each other, and a space thus formed functions as the opening 70.

In the seam 80 formed over the overall length of the transport roller 15 (roller main body 16), the opening 70 is provided in a region excluding a region where the high friction layer 50 is formed and regions supported by the bearings 26. In other words, the high friction layer 50 is formed on a substantial center portion of the transport roller 15, and both end sides of the transport roller 15 are supported by the bearings 26, and accordingly, at least two openings 70 are provided in the transport roller 15.

The openings 70 are provided for the purpose of preventing the grease L (lubricant), which is supplied (applied) to the bearings 26, from reaching the high friction layer 50 along the seam 80 (gap between the end surfaces 61*a* and 61*b*).

As mentioned above, the grease L must be supplied between the roller main body 16 and the bearings 26. Accordingly, such an action itself that an oil content of the grease L flows along the seam 80 of the surface of the roller main body 16 by the capillary action cannot be avoided. The openings 70 are provided in a part of the seam 80, whereby the capillary action of the grease L is stopped. To be more specific, in the seam 80, the openings 70 are provided between the region where the high friction layer 50 is formed and the regions supported by the bearings 26, whereby the grease L is prevented from reaching the high friction layer 50.

Moreover, a size (maximum distance d2 between the pair of notched portions 76 and 77) of each of the openings 70 is adjusted, whereby the capillary action of the grease L can be surely stopped. To be more specific, since intensity of the capillary action of the grease L is proportional to surface tension of the oil content of the grease L, and is inversely proportional to the size (maximum distance d2 between the notched portions 76 and 77 of the pair) of the seam 80, the size of each of the openings 70 is set in response to the surface tension of the grease L so as not to cause the capillary action. In other words, the maximum distance d2 between the notched portions 76 and 77 of each of the openings 70 is set.

To be more specific, if it is assumed that the surface tension of the oil content of the grease L is substantially the same as that of water, then the capillary action can be stopped by setting the maximum distance d2 between the notched portions 76 and 77 in each of the openings 70, for example, at approximately 1 mm or more. In response to such dimension setting, an axial length of each of the openings 70 is also set, for example, at approximately 1 mm or more.

Figure 5:
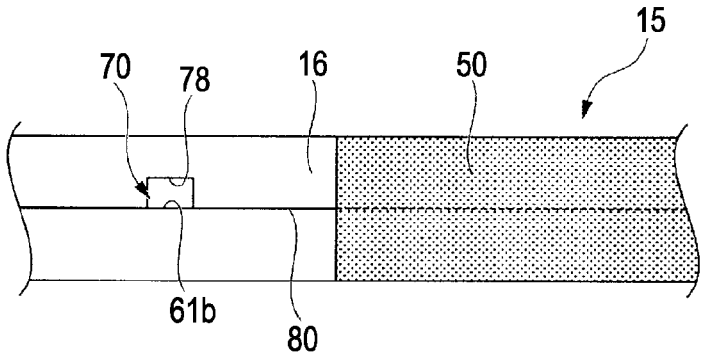
FIG. 5 is a view illustrating a modification example of the opening.

Note that the formation of the openings 70 is not limited to the case where the notched portions 76 and 77 for forming each of the openings 70 are formed on the pair of end surfaces 61*a* and 61*b*, which form the seam 80, respectively. To be more specific, as shown in FIG. 5, a notched portion 78 may be formed on only one end surface (for example, the end surface 61*a*) of the pair of end surfaces 61*a* and 61*b* forming the seam 80, and each of the openings 70 may be formed of the notched portion 78 and the end surface 61*b*. Moreover, a shape of each of the openings 70 is not limited to a rectangle, but may be a circle and the like.

Next, a description will be made of a manufacturing method of the transport roller 15.

Figure 6A:
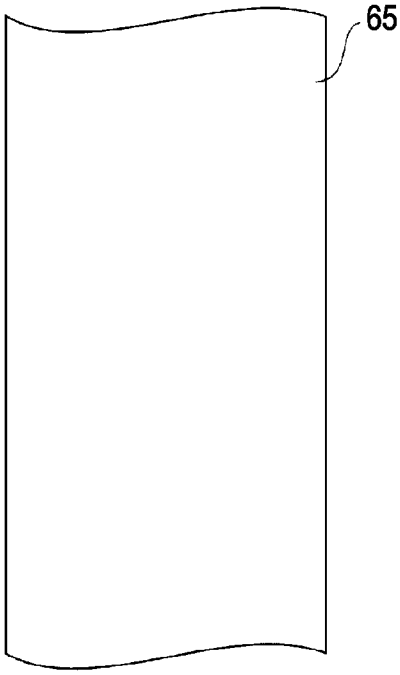
FIGS. 6A to 6C are plan views illustrating metal plates as base members of a roller main body.

In order to manufacture the transport roller 15, first, as shown in FIG. 6A, a rectangular plate-like or belt-like large metal plate 65 is prepared. As the large plate 65, a zinc-plated steel plate, for example, with a thickness of approximately 1 mm is used. Subsequently, the large metal plate 65 is pressed, whereby, as shown in FIG. 6B, a strip-like rectangular-plate like metal plate 60 with a size corresponding to the roller main body 16, that is, a base member of the roller main body 16 is formed.

Figure 6B:
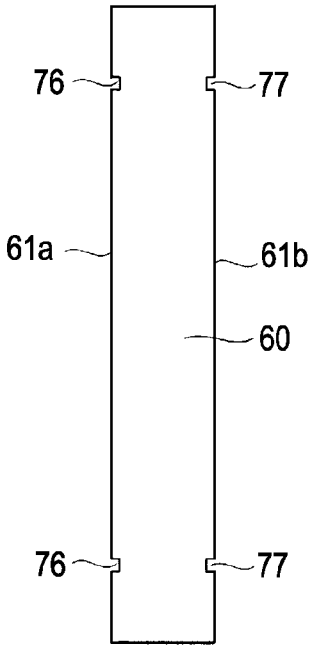

Moreover, as shown in FIG. 6B, on the pair of end surfaces 61*a* and 61*b* of the metal plate 60, the notched portions 76 and 77, which form the openings 70 later, are formed, respectively.

Figure 6C:
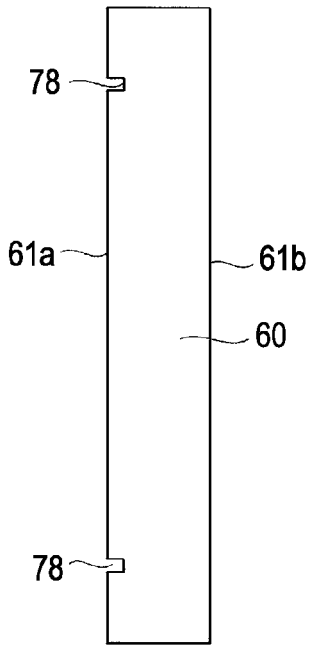

Note that, as shown in FIG. 6C, the notched portions 78 which form the openings 70 later may be formed only on the end surface 61*a* as one of the pair of end surfaces of the metal plate 60 (refer to FIG. 5).

Subsequently, as illustrated in pressing process diagrams of FIGS. 7A to 7C and FIGS. 8A to 8C, the metal plate 60 is pressed into a cylindrical shape (pipe shape), and the end surfaces 61*a* and 61*b* on both sides (long sides) thereof are allowed to approach each other.

Figure 7A:
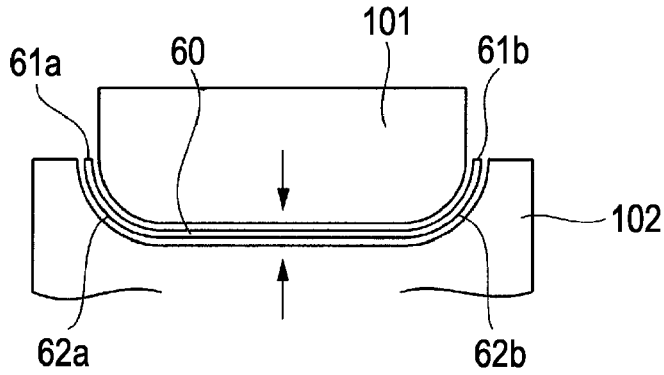
FIGS. 7A to 7C are process diagrams illustrating press working for the metal plate.

To be more specific, first, the metal plate 60 is pressed by a male die 101 and a female die 102, which are shown in FIG. 7A, and both side portions 62*a* and 62*b* of the metal plate 60 are bent into a circular arc shape (desirably, substantially a ¼ circular arc). Note that, in FIG. 7A, in order to clearly show the metal plate 60, the male die 101 and the female die 102, these respective members are illustrated while having intervals thereamong. However, these intervals do not exist actually, and the metal plate 60, the male die 101 and the female die 102 are brought into substantially direct contact with one another on contact portions thereof. This is also applied similarly to FIGS. 7B and 7C and FIGS. 8A to 8C, which will be described later.

Figure 7B:
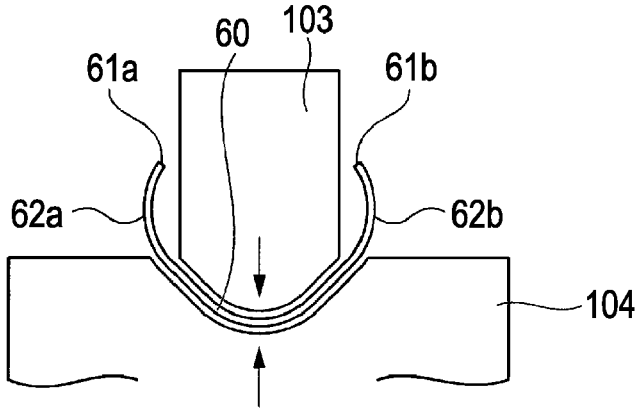

Subsequently, a center portion in a width direction (bending direction) of the metal plate 60 obtained in FIG. 7A is pressed by a male die 103 and a female die 104, which are shown in FIG. 7B, and is bent into a circular arc shape (desirably, substantially a ¼ circular arc).

Figure 7C:
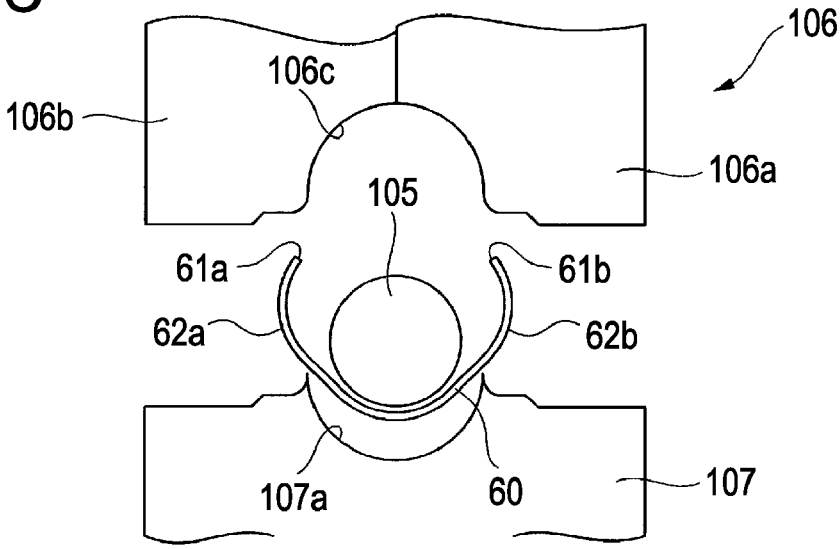
Figure 8A:
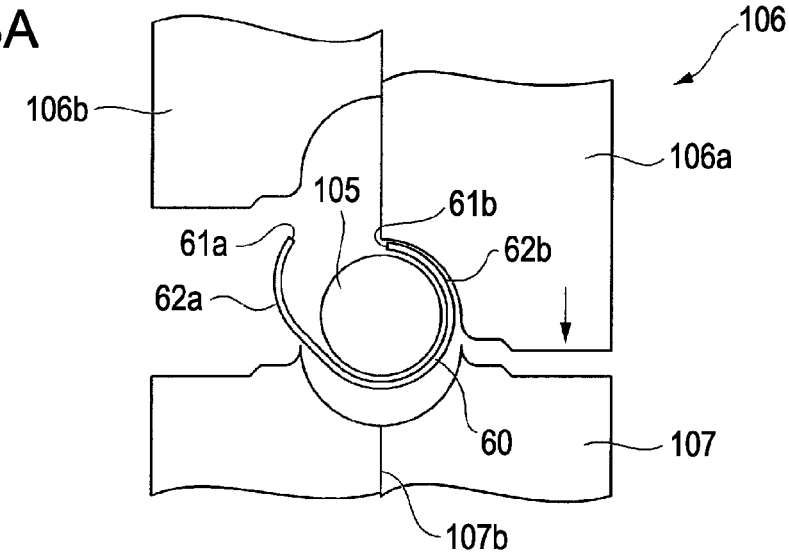
FIGS. 8A to 8C are process diagrams illustrating the press working for the metal plate.
Figure 8B:
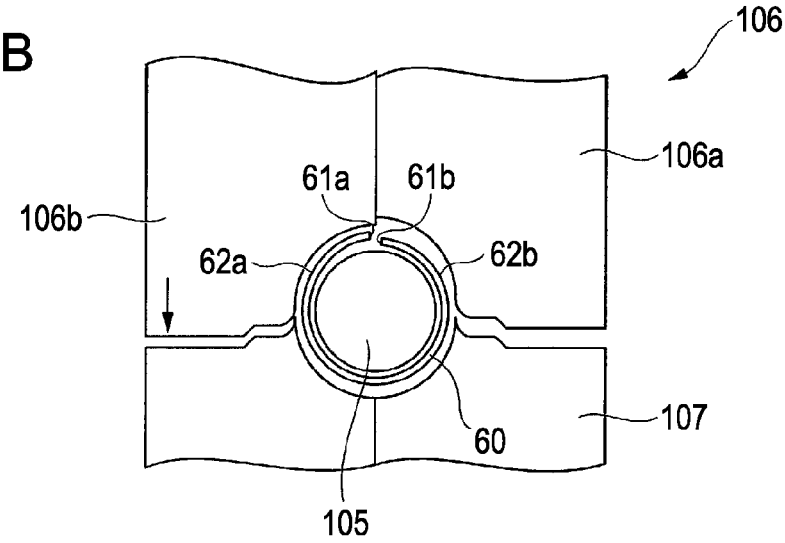
Figure 8C:
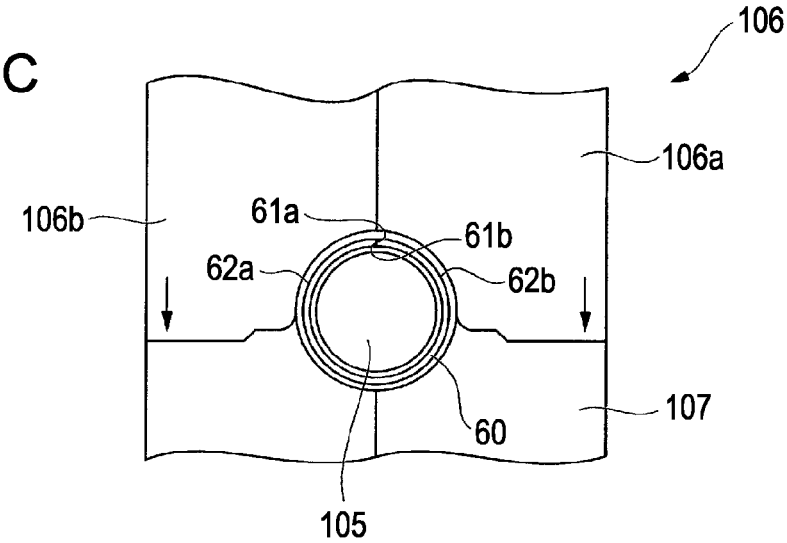

Subsequently, as shown in FIG. 7C, a core die 105 is arranged in an inside of the metal plate 60 obtained in FIG. 7B, and by using an upper die 106 and a lower die 107, which are shown in FIG. 7C, the respective end surfaces 61*a* and 61*b* of both side portions 62*a* and 62*b* of the metal plate 60 are made to approach each other as shown in FIGS. 8A to 8C.

Here, an outer diameter of the core die 105 shown in FIG. 7C and FIGS. 8A to 8C is set equal to an inner diameter of a cylindrical hollow pipe to be formed. Moreover, each of a radius of a press surface 106*c* of the upper die 106 and a radius of a press surface 107*a* of the lower die 107 is set equal to a radius of an outer diameter of the hollow pipe to be formed. Furthermore, as shown in FIGS. 8A to 8C, the upper die 106 includes a right and left pair of split dies 106*a* and 106*b*, and the split dies 106*a* and 106*b* are configured so as to be ascendable/descendable independently of each other.

To be more specific, from a state shown in FIG. 7C, the right split die 106*a* is allowed to descend relatively to the lower die 107 as shown in FIG. 8A. Hereinafter, the movement of the die stands for relative movement in a similar way. Then, one side of the metal plate 60 is pressed to be bent into a substantially semicircular shape. Note that, in a similar way to the upper die 106, the lower die 107 may include a right and left pair of split dies (refer to a split surface 107*b*), and the split die of the lower die on the same side, may be allowed to ascend during the process shown in FIG. 8A.

Subsequently, as shown in FIG. 8B, the core die 105 is allowed to descend a little (to an extent where the one-side end surface 61*a* and the other-side end surface 61*b* can be allowed to approach each other). In addition, the other-side split die 106*b* is allowed to descend, and the other side of the metal plate 60 is pressed to be bent into the substantially semicircular shape.

Thereafter, as shown in FIG. 8C, the core die 105 and the pair of split dies 106*a* and 106*b* are allowed to descend together, and the cylindrical hollow pipe (roller main body 16) is formed. In this state, both of the right and left end surfaces 61*a* and 61*b* sufficiently approach each other while interposing a slight gap therebetween. In other words, in the cylindrical hollow pipe, both end surfaces 61*a* and 61*b* of the metal plate 60 as the base member are configured to approach each other, whereby a seam is formed between both end surfaces 61*a* and 61*b*, and hence, the seam has a gap because both end surfaces 61*a* and 61*b* are slightly spaced apart from each other.

Subsequently, in this embodiment, in order to enhance roundness of the formed hollow pipe (roller main body 16) and to reduce a runout thereof, the hollow pipe (roller main body 16) is subjected to a centerless grinding process publicly known heretofore, and an outer circumferential surface thereof is ground.

Then, the hollow pipe becomes the roller main body 16, in which the roundness is improved more than before the centerless grinding process, and an amount of runout is also small. Moreover, in the roller main body 16, the interval between both end surfaces 61*a* and 61*b* is narrowed more, whereby the seam 80 is formed as shown in FIG. 4A, in which the gap between both end surfaces 61*a* and 61*b* is narrowed more.

In the press working and the centerless grinding process, it is preferable that the gap between both end surfaces 61*a* and 61*b* of the metal plate 60 be eliminated, in other words, that both end surfaces 61*a* and 61*b* abut on each other. However, it is extremely difficult to completely eliminate the gap while improving the roundness and amount of runout of the obtained hollow pipe (roller main body 16). Hence, some gap is formed under the present circumstances.

After the roller main body 16 is formed as described above, the high friction layer 50 is formed on the surface of the roller main body 16 as shown in FIG. 3.

As a forming method of the high friction layer 50, a dry method and a wet method (or a method using both of them in combination) are adoptable; however, the dry method is suitably adopted in this embodiment.

To be more specific, first, resin particles and inorganic particles are prepared as forming materials of the high friction layer 50. As the resin particles, suitably used are microparticles with a diameter approximately ranging from 10 to 20 μm, which are made of epoxy resin or polyester resin.

As the inorganic particles, suitably used are particles of ceramics such as aluminum oxide (alumina: $Al_2O_3$), silicon carbide (SiC) and silicon dioxide ($SiO_2$). Among them, the alumina is more suitably used since the alumina has relatively high hardness, and favorably exerts a function to enhance friction resistance, and in addition, cost thereof is relatively low, and cost reduction is not inhibited thereby. Hence, in this embodiment, alumina particles 52 are used as the inorganic particles. As the alumina particles 52, those adjusted at a predetermined particle diameter distribution by pulverization treatment are used. The alumina particles 52 are produced by the pulverization treatment, whereby end portions of the alumina particles 52 become relatively sharpened, and the alumina particles 52 exert high frictional force.

The resin particles are applied onto the roller main body 16. To be more specific, the roller main body 16 is arranged in a painting booth (not shown), and is then charged, for example, with a – (negative) potential in a state of being separated.

Then, the resin particles are sprayed (ejected) toward the roller main body 16 by using a tribo-charging gun of an electrostatic painting apparatus (not shown), and at the same time, the sprayed particles (resin particles) are charged with a high + (positive) potential. Then, the charged resin particles are adsorbed to the outer circumferential surface of the roller main body 16, and form a resin film 51.

Figure 9A:
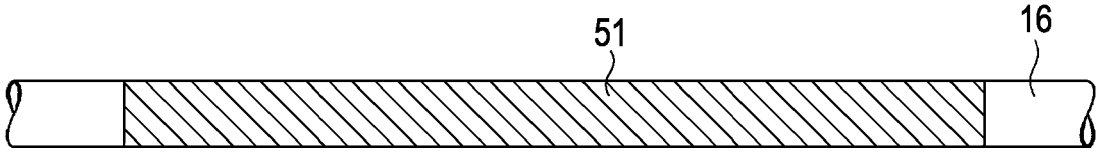
FIGS. 9A to 9C are diagrams illustrating processes of forming a high friction layer on the roller main body.

Here, in response to the region where the high friction layer 50 is formed, which is shown in FIG. 3, the formation of the resin film by spraying the resin particles is performed only for the center portion of the roller main body 16, which excludes both end portions thereof, as shown in FIG. 9A without being performed over the overall length thereof. The formation of the resin film is performed, for example, by masking both end portions concerned by a tape in advance. In other words, the resin film 51 is selectively formed only on the center portion of the roller main body 16. In the resin film 51, positive static electricity as weak as approximately 0.5 KV remains after such spray painting.

During the spray painting, the roller main body 16 is rotated about an axis thereof, whereby the resin film 51 is formed to a substantially uniform thickness over the entire circumference of the roller main body 16.

With regard to the film thickness of the resin film 51, the resin film 51 is formed, for example, to a thickness approximately ranging from 10 μm to 30 μm in consideration of a particle diameter of the alumina particles 52. Such a film thickness can be appropriately adjusted by a spray amount, spray time and the like of the resin particles.

Figure 10:
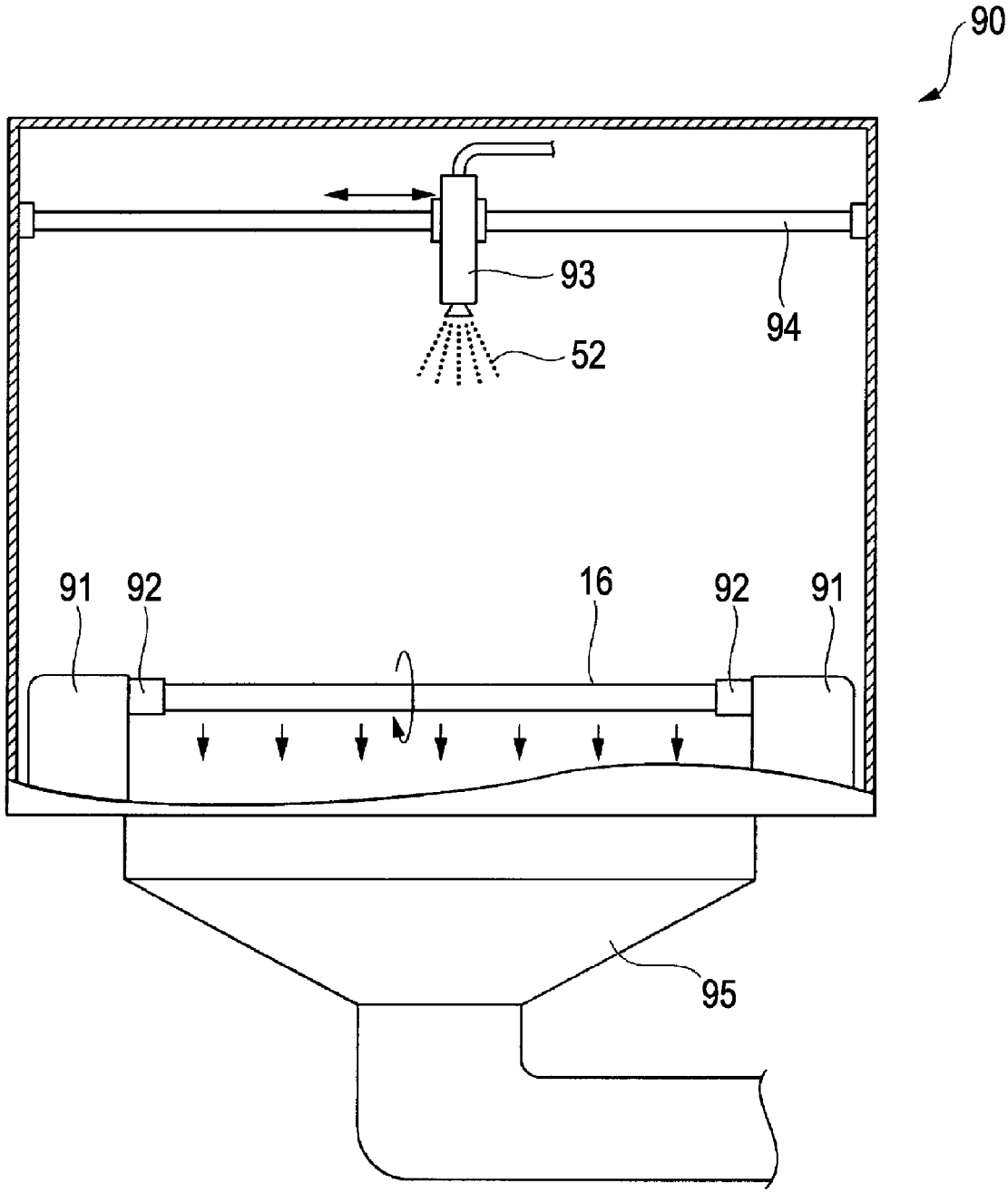
FIG. 10 is a schematic configuration view of a painting booth for forming the high friction layer.

Subsequently, the roller main body 16 on which the resin film 51 is formed is taken out of the painting booth, and is transferred to another painting booth 90 shown in FIG. 10 by a handling robot (not shown). In a lower portion of the painting booth 90, a pair of rotational drive members 91, 91 are provided. On these rotational drive members 91, 91, chucks 92, 92 for supporting the roller main body 16 substantially in horizontal are provided. Both end portions of the roller main body 16 are held and fixed by the chucks 92, 92, and the chucks 92, 92 are rotated by the rotational drive members 91, 91. Accordingly, the roller main body 16 is rotationally driven about the axis thereof slowly at a speed, for example, as low as approximately 100 rpm to 500 rpm. Note that, naturally, the roller main body 16 may be supported somewhat obliquely.

A corona gun 93 is arranged in an upper portion of the painting booth 90. The corona gun 93 moves on a shaft 94 in a right and left direction in FIG. 10. Moreover, an exhaust mechanism 95 is provided on a bottom portion of the painting booth 90, whereby a slow airflow that goes downward is formed in the painting booth 90. An air suction rate of the exhaust mechanism 95 is set as appropriate.

With such a configuration, the alumina particles 52 are sprayed from the corona gun 93 toward the roller main body 16 while rotating the roller main body 16 about the axis thereof, whereby the alumina particles 52 are electrostatically adsorbed selectively on the resin film 51 formed on the roller main body 16. In a similar way to the formation of the resin film 51, both end portions of the roller main body 16 are masked by the tape in order to electrostatically adsorb the alumina particles 52 selectively on the resin film 51.

At the time of such electrostatic painting, surface potentials of the chucks 92, 92 and the rotational drive members 91, 91 are set so as to be substantially equal to the potential of the roller main body 16, and in addition, an inner surface potential of the painting booth 90 is set so as to be an approximately zero potential that is electrically neutral. This is for preventing the alumina particles 52 from the corona gun 93 from being adsorbed to portions other than the roller main body 16. In order to hold the inner surface potential of the painting booth 90 to be electrically neutral, it is desirable to manufacture the painting booth 90 by using a steel plate in which electric resistance of an inner surface is, for example, approximately 1011Ω.

Thereafter, a potential applied to the corona gun 93 is set at 0 V, and further, a pressure of air supplied to the corona gun 93 is set as low as approximately 0.2 Mpa. The corona gun 93 is allowed to spray the alumina particles 52, which is set at the substantially zero potential, from above while being moved in the right and left direction in FIG. 10, and the alumina particles 52 are allowed to freely fall in the vertical direction by self weight thereof. Then, as mentioned above, the weak static electricity (approximately +0.5 KV) remains in the resin film 51 of the roller main body 16 since the resin film 51 is formed by the electrostatic painting, and accordingly, by the static electricity, the alumina particles 52 electrostatically adsorb to the entire circumference of the resin film 51 substantially uniformly. In a state of abutting on a surface of the resin film 51 and partially entering the resin film 51, the alumina particles 52 which have electrostatically adsorbed to the resin film 51 as described above attach to the outer circumferential surface of the roller main body 16 while using the resin film 51 as a binder.

In this embodiment, the inner surface potential of the painting booth 90 is approximately zero potential that is electrically neutral, and in addition, the airflow in the painting booth 90 goes slowly downward. Accordingly, the alumina particles 52 freely fall downward in the vertical direction by the self weight thereof. Below in such a falling direction, the roller main body 16 supported horizontally rotates slowly about the axis thereof. Accordingly, the alumina particles 52 are sprayed substantially uniformly on the outer circumferential surface of the roller main body 16.

Figure 9B:
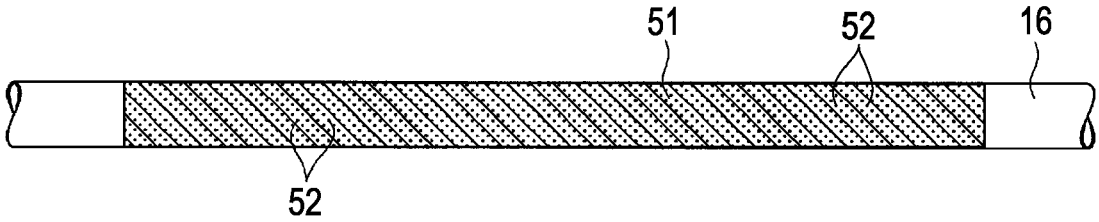

Hence, the alumina particles 52 uniformly attach particularly to the unmasked surface of the resin film 51, and accordingly, as shown in FIG. 9B, in the roller main body 16, in the resin film 51 on the center portion thereof, the alumina particles 52 are dispersed and exposed. To be more specific, at the time of abutting on the resin film 51 by the electrostatic absorption force, a part of the alumina particles 52 enters the resin film 51, and the rest thereof protrudes from the surface of the resin film 51. At this time, the alumina particles 52 become likely to be erected perpendicularly with respect to the surface of the roller main body 16, and accordingly, the alumina particles 52 are distributed uniformly, and most of them attach to the surface of the resin film 51 while directing the sharpened end portions (top portions) thereof outward.

Hence, the alumina particles 52 exert large frictional force by the end portions thereof protruding from the surface of the resin film 51. In order that the alumina particles 52 can exert necessary and sufficient frictional force for the sheet P, it is preferable that the ratio of an occupation area of the alumina particles 52 with respect to an area of the resin film 51 become 20% to 80%.

Note that, with regard to the application (spraying) of the alumna particles, a method thereof is not limited to the electrostatic painting method as long as the alumina particles 52 are slowly sprayed downward in the vertical direction, and for example, the application method may be an application (spraying) method using a spray gun may be applicable.

Figure 9C:
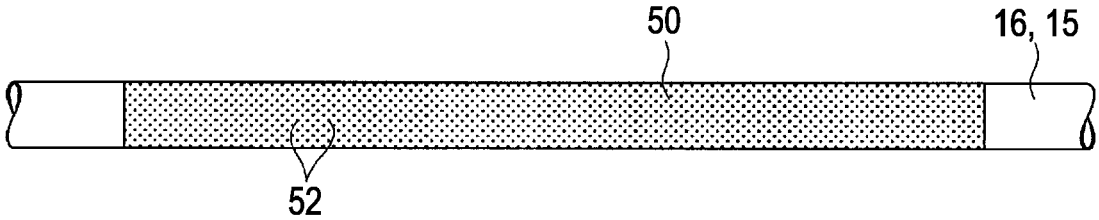

After the alumina particles 52 are sprayed and attached onto the resin film 51 as described above, the roller main body 16 is heated at a temperature approximately ranging from 180° C. to 300° C. for a time approximately ranging from 20 minutes to 30 minutes, and the resin film 51 is fired and cured, whereby the alumina particles 52 are fixedly attached to the roller main body 16. Accordingly, the high friction layer 50 configured in such a manner that the alumina particles 52 are dispersed in and exposed from the resin film 51 is formed as shown in FIG. 9C, and the transport roller 15 is obtained.

In the above-mentioned embodiment, the application (spraying) of the resin particles and the application (spraying) of the alumina particles 52 (inorganic particles) are performed in the painting booths different from each other, however, may be performed in the same painting booth.

Next, a description will be made of operations of the ink jet printer 1 with reference to FIG. 1 and FIGS. 2A and 2B.

Upon reaching the vicinity of an upstream side of the transport roller mechanism 19, the sheet P fed by the sheet feed roller 13 is pulled in between the transport roller 15 and the driven roller 17, and by the drive of both of the rollers, is transported at a constant speed toward the printing head 21 located downstream.

At this time, since the high friction layer 50 is formed on the transport roller 15, and the driven roller 17 is arranged at the position of abutting on the high friction layer 50, the pinching force for the sheet P is increased between the transport roller 15 and the driven roller 17, and the transportability for the sheet P is improved more.

Moreover, in the transport roller 15, since the grease L supplied to the bearings 26 is prevented from adhering to the high friction layer 50, the sheet P is not soiled with the grease L, and accurate and stable sheet feeding (transportation) is performed.

Then, when a printing start end of the sheet P reaches a predetermined printing position immediately under the printing head (printing unit) 21, the printing is started. Thereafter, when the printing start end of the sheet P reaches the discharge roller mechanism 29, a discharge operation is started.

The discharge speed of the discharge roller mechanism 29 is set faster than the transport speed of the transport roller mechanism 19, and accordingly, the sheet P is transported in a state of being applied with back tension. However, when both of the transport roller mechanism 19 and the discharge roller mechanism 29 pinch the sheet P, the discharge speed for the sheet P is defined by the transport speed of the transport roller mechanism 19 as mentioned above.

Hence, also at the time of simultaneously performing the discharge and the transport by the discharge roller mechanism 29 and the transport roller mechanism 19 as described above, the accurate and stable sheet feeding (transportation) free from transportation unevenness is performed since such a sheet discharge speed is defined by the transport speed of the transport roller mechanism 19.

As described above, in accordance with the transport roller 15 according to this embodiment, even in the case of using the cylindrical shaft formed into the cylindrical shape by the press working, the sheet (medium) P in contact with the high friction layer (medium supporting region) 50 can be prevented from being soiled with the grease L (liquid) attached to the transport roller 15. To be more specific, the openings 70 formed in the seam 80 function as flow stoppers for the grease L flowing through the seam 80, and accordingly, the grease L can be prevented from permeating the high friction layer 50. Moreover, the high friction layer 50 can be prevented from being soiled with the grease L, and accordingly, favorable transport capability can be maintained.

Moreover, in accordance with the transport unit (transport device) 20 of this embodiment, since the above-mentioned transport roller 15 is provided, it is possible to reduce cost and weight of the transport unit 20 concerned, and further, favorable transport can be realized without soiling the sheet P.

Furthermore, in accordance with the ink jet printer (printing apparatus) 1, since the above-mentioned transport unit 20 is provided, it is possible to reduce cost and weight of the ink jet printer 1 concerned, and printing with higher quality can be performed.

Note that the invention is not limited to the above-mentioned embodiment, and is modifiable in various ways within the scope without departing from the gist thereof.

For example, the seam of the transport roller 15 (roller main body 16) is not limited to the above-mentioned embodiment, and a variety of shapes are adoptable as illustrated as below.

FIGS. 11 to 15 are views illustrating modification examples of the seam and the openings.

Figure 11:
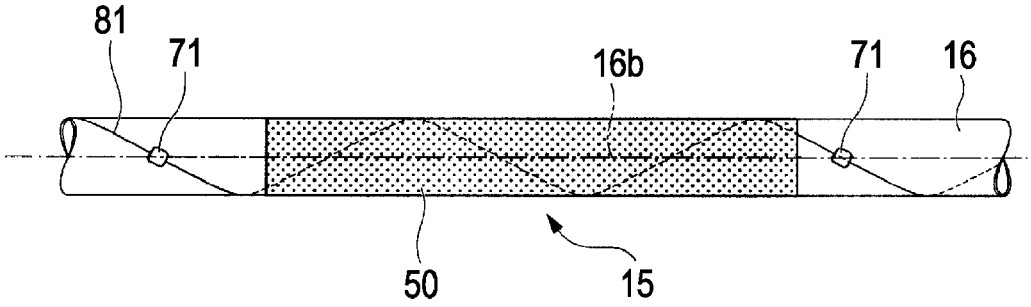
FIG. 11 is a view illustrating a modification example of a seam and opening of a transport roller.
Figure 12:
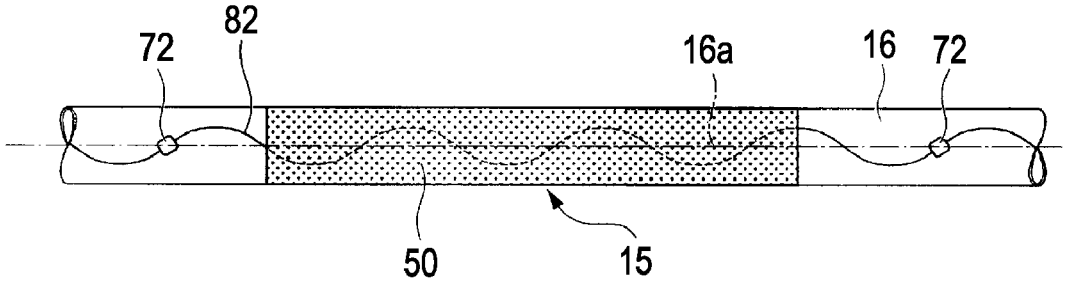
FIG. 12 is a view illustrating another modification example of the seam and opening of the transport roller.

As shown in FIG. 11, a seam 81 may be formed into a spiral shape. Moreover, as shown in FIG. 12, a seam 82 may be formed into a wavy line shape. Openings 71 and 72 are partially provided in the seams 81 and 82, respectively.

Figure 13:
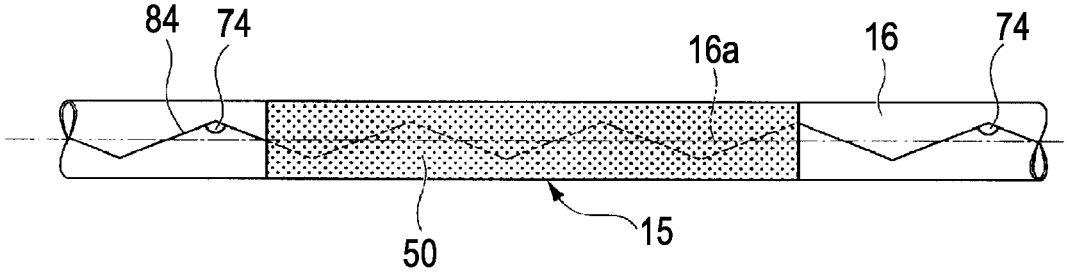
FIG. 13 is a view illustrating more another modification example of the seam and opening of the transport roller.

Moreover, as shown in FIG. 13, a seam 84 may be formed into a zigzag (shape in which a straight line is bent from side to side many times) shape. Openings 74 can be provided at bent portions of the seam 84.

Figure 14A:
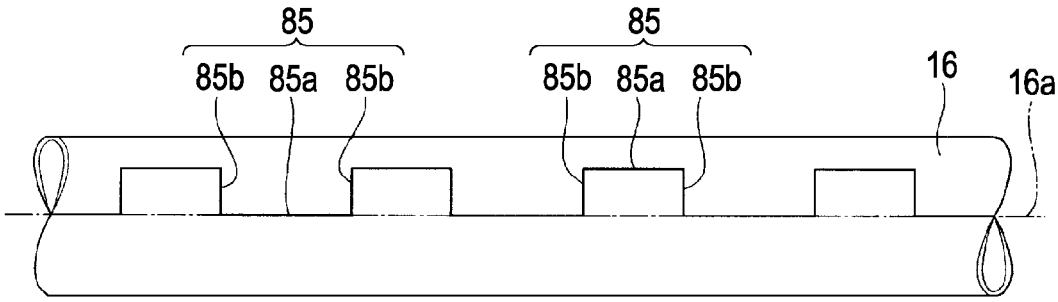
FIGS. 14A to 14C are views illustrating modification examples of the seams of the transport rollers.

Moreover, as shown in FIG. 14A, square wave-like seams 85 may be formed, each of which includes linear portions 85*a* parallel to a central axis 16*a* of the roller main body 16, and linear portions 85*b* perpendicular thereto.

Figure 14B:
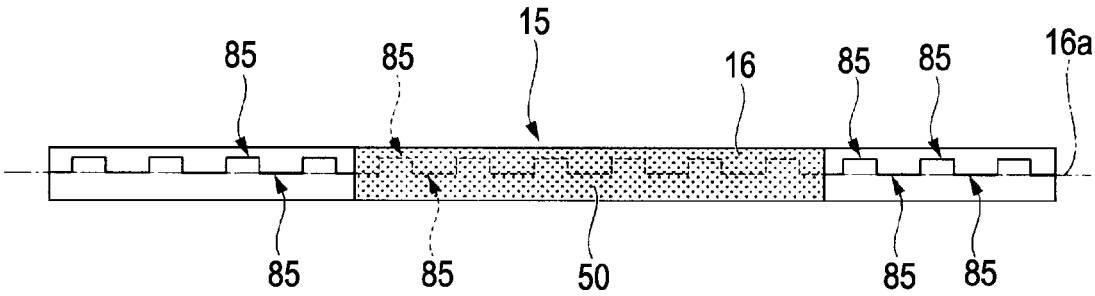
Figure 14C:
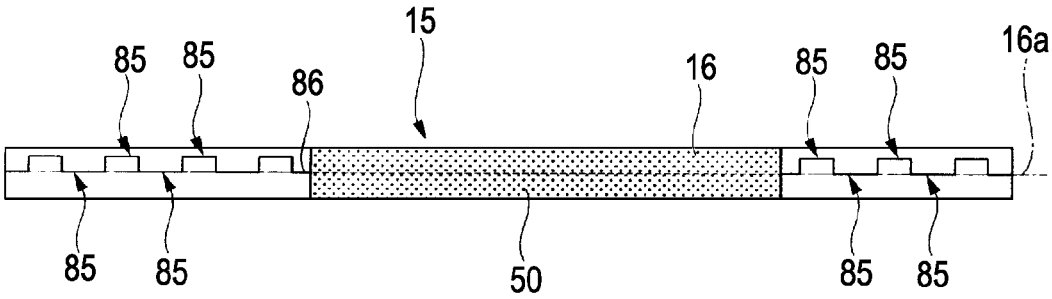

The seams 85 may be formed over the overall length of the roller main body 16 as shown in FIG. 14B, or may be selectively formed on both end portions thereof, which exclude the center portion, as shown in FIG. 14C.

In the case of forming the seams 85 only on both end portions as shown in FIG. 14C, for example, a portion between the seams 85 formed on both end portions can be formed, for example, into a linear portion 86 parallel to the central axis of the roller main body 16.

In the case where the seams 85 are formed only on both end portions and such a center portion therebetween is formed into the linear portion 86 as described above, it is preferable that the formed region of the high friction layer 50 be formed so as to correspond to the linear portion 86.

Figure 15A:
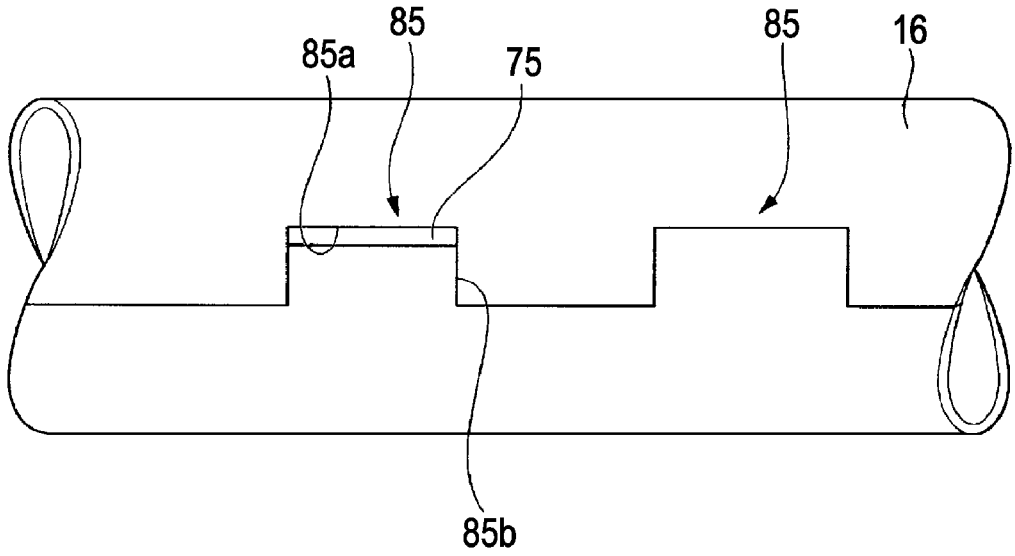
FIGS. 15A and 15B are views illustrating modification examples of the opening of the transport roller.
Figure 15B:
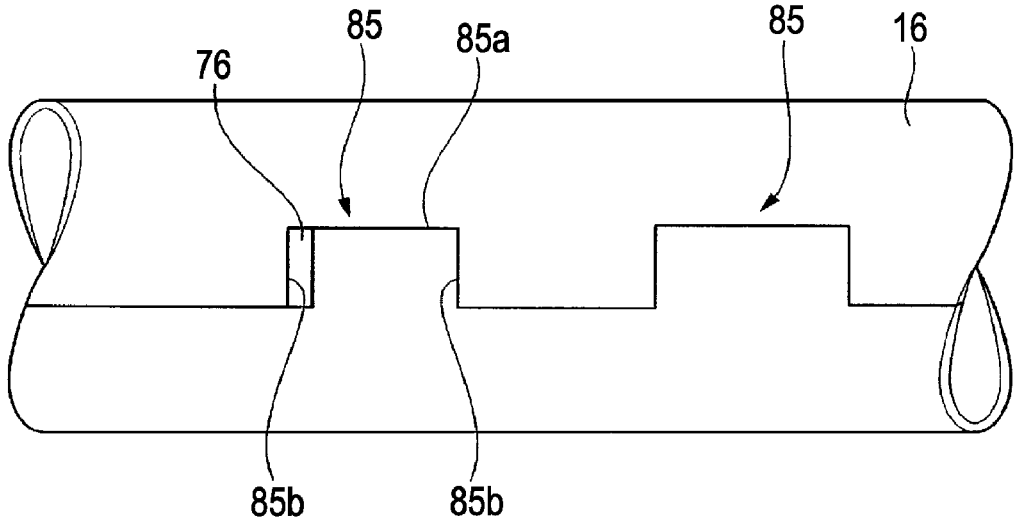

For each of the seams 85, an opening 75 may be formed on a linear portion 85*a* parallel to the central axis 16*a* as shown in FIG. 15A, or an opening 76 may be formed on a linear portion 85*b* perpendicular to the central axis 16*a* as shown in FIG. 15B.

A shape, number, arrangement, distribution and the like of the openings 70 can be changed as appropriate.

For example, a plurality of the openings are arranged so as to be continuous with one another along the seam, whereby the flow of the liquid such as the grease L can be surely stopped. A decrease in rigidity of the transport roller can be suppressed more in the case where a plurality of small openings are continuously provided than in the case where one large opening is provided.

It is preferable that the openings be formed in regions of the transport roller, which are closer to the medium supporting region than such liquid-attached spots thereof. The openings are provided in the regions close to the medium supporting region, whereby the medium supporting region can be surely prevented from being soiled with the grease L.

In the above-mentioned embodiment, the transport roller according to the invention is applied to the transport roller 15 in the transport roller mechanism 19; however, is not limited to such application. The transport roller according to the invention can also be applied to the discharge roller 27 and the discharge Giza roller 28 in the discharge roller mechanism 29. Moreover, the transport roller according to the invention can also be applied to the driven roller 17 in the transport roller mechanism 19.

Moreover, the transport roller according to the invention can also be applied to a transport roller that transports a medium other than the sheet.

Furthermore, the transport roller according to the invention can also be applied to a transport roller and a transport device, which are used for other than the printing apparatus.

The liquid that attaches to the transport roller and flows through the seam by the capillary action is not limited to the grease L supplied to the bearings. The liquid may be another grease L supplied to the transport drive gear attached to the transport roller. Moreover, the liquid may be a liquid such as ink that attaches to the transport roller during maintenance.

What is claimed is:

1. A transport device comprising:

a transport roller that is formed into a cylindrical shape in such a manner that a pair of end surfaces thereof are matched with each other by press working, and includes a medium supporting region in a part thereof in a longitudinal direction, while the medium supporting region supporting a medium; and a bearing that pivotally supports a region of the transport roller, the region being other than the medium supporting region, wherein the transport roller includes an opening in the region other than the medium supporting region in a seam formed by matching the pair of end surfaces with each other.

2. The transport device according to claim 1, wherein the opening is arranged between the medium supporting region and the region supported by the bearing.

3. The transport device according to claim 1, wherein at least one opening is arranged on each of both sides of the medium supporting region.

4. The transport device according to claim 1, wherein a distance between the pair of end surfaces in the opening is set in response to surface tension of lubricant supplied to the bearing.

5. The transport device according to claim 1, wherein the medium supporting region is provided on a center portion of the transport roller, the center portion excluding both end portions thereof.

6. The transport device according to claim 1, wherein the medium supporting region is made of a high friction layer containing inorganic particles.

7. A printing apparatus comprising:

a printing unit that performs print processing for a recording medium; and a transport unit that transports the recording medium, the transport unit including:

a transport roller for transporting the recording medium, the transport roller being formed into a cylindrical shape in such a manner that a pair of end surfaces thereof are matched with each other by press working, and includes a medium supporting region in a part thereof in a longitudinal direction, while the medium supporting region supporting a medium; and a bearing that pivotally supports a region of the transport roller, the region being other than the medium supporting region, wherein the transport roller includes an opening in the region other than the medium supporting region in a seam formed by matching the pair of end surfaces with each other.

8. The printing apparatus according to claim 7, wherein the opening is arranged between the medium supporting region and the region supported by the bearing.

9. The printing apparatus according to claim 7, wherein at least one opening is arranged on each of both sides of the medium supporting region.

10. The printing apparatus according to claim 7, wherein a distance between the pair of end surfaces in the opening is set in response to surface tension of lubricant supplied to the bearing.

11. The printing apparatus according to claim 7, wherein the medium supporting region is provided on a center portion of the transport roller, the center portion excluding both end portions thereof.

12. The printing apparatus according to claim 7, wherein the medium supporting region is made of a high friction layer containing inorganic particles.

13. A transport roller comprising;

a medium supporting region supporting a medium in a part thereof in a longitudinal direction, formed into a cylindrical shape in such a manner that a pair of end surfaces thereof are matched with each other by press working, an opening in a region other than the medium supporting region in a seam formed by matching the pair of end surfaces with each other.

* * * * *